US011231184B2

(12) United States Patent
Chung et al.

(10) Patent No.: US 11,231,184 B2
(45) Date of Patent: Jan. 25, 2022

(54) OUTDOOR UNIT OF GAS HEAT PUMP SYSTEM

(71) Applicant: LG ELECTRONICS INC., Seoul (KR)

(72) Inventors: Minho Chung, Seoul (KR); Kyoungyoul Lee, Seoul (KR); Song Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 16/764,929

(22) PCT Filed: Nov. 19, 2018

(86) PCT No.: PCT/KR2018/014217

§ 371 (c)(1),
(2) Date: May 18, 2020

(87) PCT Pub. No.: WO2019/098794

PCT Pub. Date: May 23, 2019

(65) Prior Publication Data

US 2020/0340688 A1 Oct. 29, 2020

(30) Foreign Application Priority Data

Nov. 20, 2017 (KR) ..... 10-2017-0155040

(51) Int. Cl.
*F24F 1/10* (2011.01)

(52) U.S. Cl.
CPC ..... *F24F 1/10* (2013.01)

(58) Field of Classification Search
CPC ..... F24F 1/12; F24F 1/10; F24F 1/16; F25B 43/006; F25B 2339/0442; F25B 2339/044;

(Continued)

(56) References Cited

U.S. PATENT DOCUMENTS

2003/0089493 A1* 5/2003 Takano ..... B60H 1/00914 165/202
2014/0033741 A1* 2/2014 Song ..... F24F 1/26 62/77
2015/0075206 A1* 3/2015 Amakawa ..... F25B 27/00 62/324.6

FOREIGN PATENT DOCUMENTS

EP 1096210 5/2001
EP 3150938 4/2017

(Continued)

OTHER PUBLICATIONS

KR-20150048403-A Translation (Year: 2015).*

(Continued)

*Primary Examiner* — Schyler S Sanks
(74) *Attorney, Agent, or Firm* — Ked & Associates LLP

(57) ABSTRACT

The present disclosure relates to an outdoor unit for an air conditioner. The present invention relates to an outdoor unit of a gas heat pump system. An outdoor unit of a gas heat pump system according to an embodiment of the present invention comprises: a storage tank which is disposed at a suction side of a compressor and stores a refrigerant to be supplied to the compressor; and a heat exchanger for performing heat exchange of a refrigerant flowing through a refrigerant pipe or cooling water flowing through a cooling water pipe, wherein the heat exchanger is supported by the storage tank. Therefore, the outdoor unit does not require a separate frame structure for installing the heat exchanger.

11 Claims, 9 Drawing Sheets

(58) Field of Classification Search
CPC ..... F25B 27/02; F25B 2327/001; F25B 2400/051; F25B 2400/23; B60H 1/00521; B60H 1/04; B60H 1/08; B60H 2001/3291
See application file for complete search history.

(56) References Cited

FOREIGN PATENT DOCUMENTS

| | | | | |
|---|---|---|---|---|
| JP | 2001-124442 | | | 5/2001 |
| JP | 2004-285836 | | | 10/2004 |
| JP | 2010-019533 | | | 1/2010 |
| JP | 2010-121894 | | | 6/2010 |
| KR | 10-2008-0058782 | | | 6/2008 |
| KR | 10-0941604 | | | 2/2010 |
| KR | 10-2010-0036789 | | | 4/2010 |
| KR | 20100036789 | A | * | 4/2010 |
| KR | 10-1341533 | | | 1/2014 |
| KR | 20150048403 | A | * | 5/2015 |
| KR | 10-1714900 | | | 3/2017 |

OTHER PUBLICATIONS

KR-20100036789-A (Year: 2010).*
International Search Report dated Feb. 27, 2019 issued in Application No. PCT/KR2018/014217.
Korean Office Action dated Apr. 9, 2019 issued in Application No. 10-2017-0155040.
European Search Report dated Jul. 2, 2021 issued in Application No. 18879922.5.

* cited by examiner

[Fig. 1]
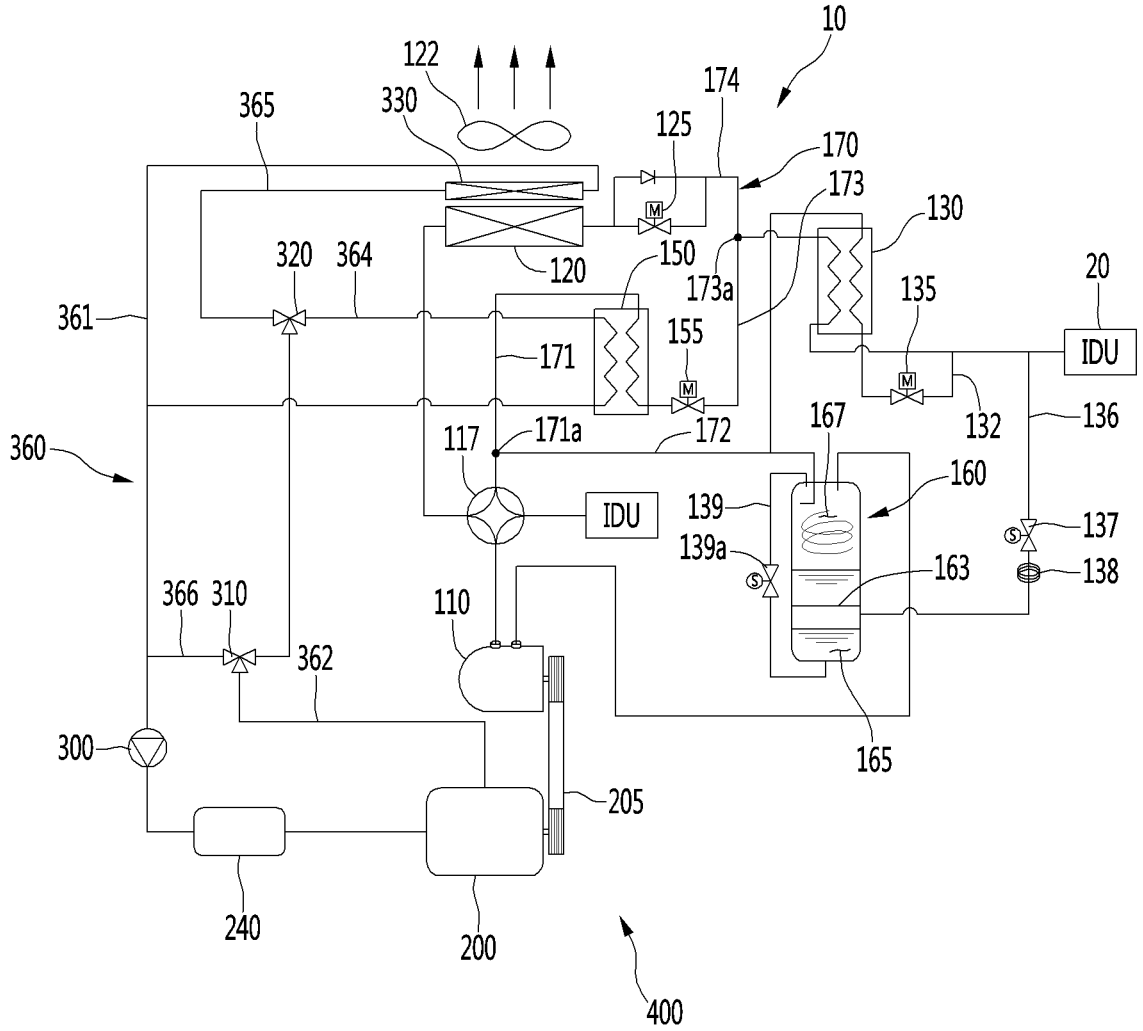

[Fig. 2]
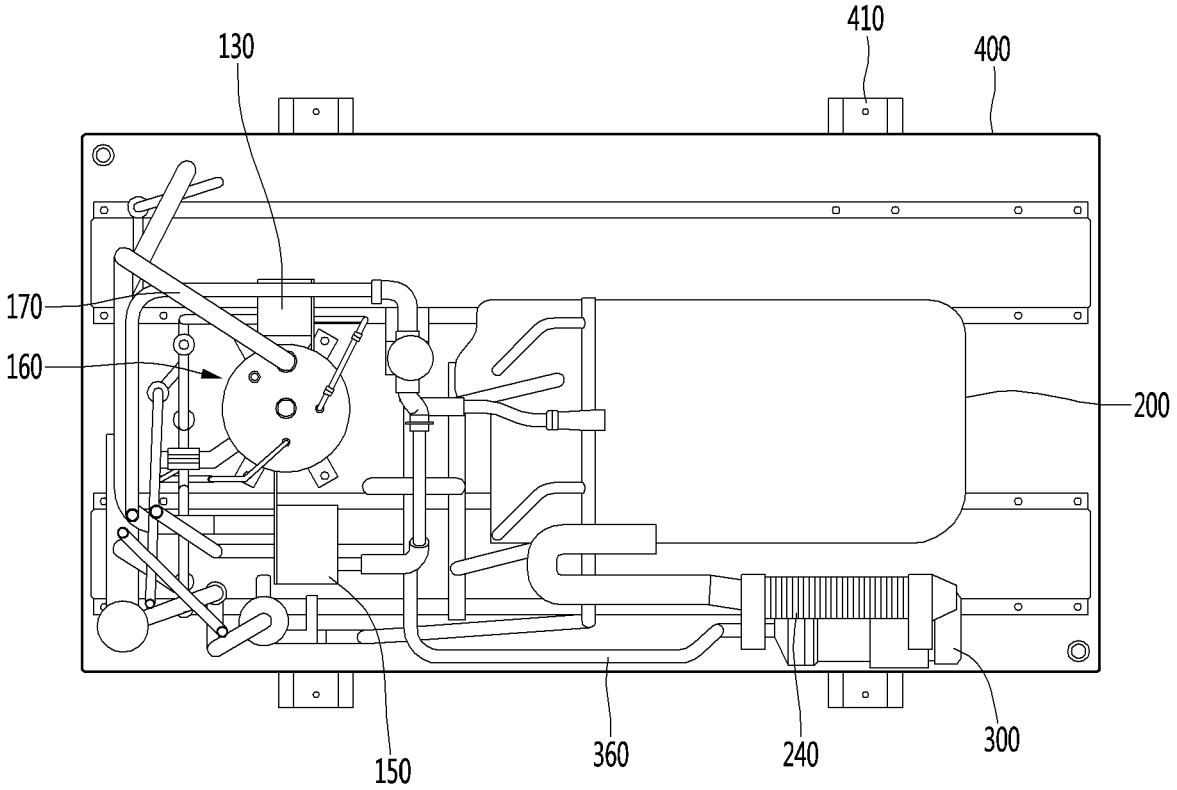

[Fig. 3]
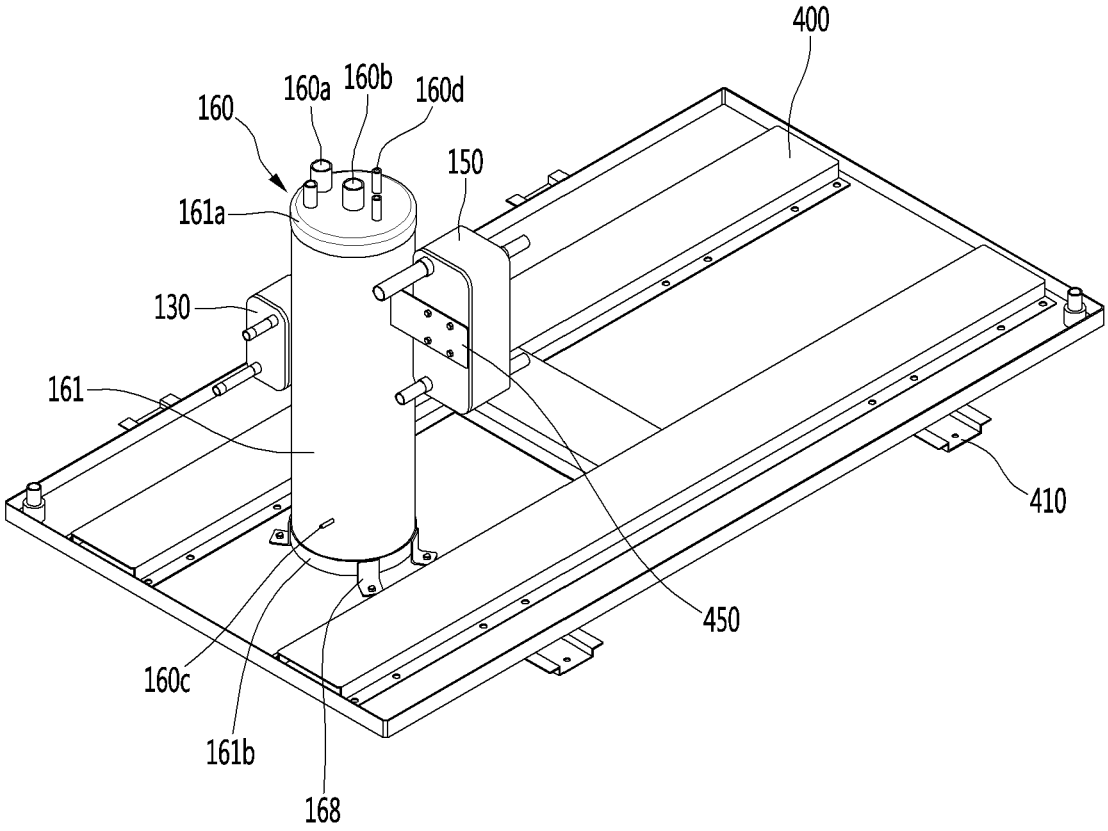

[Fig. 4]
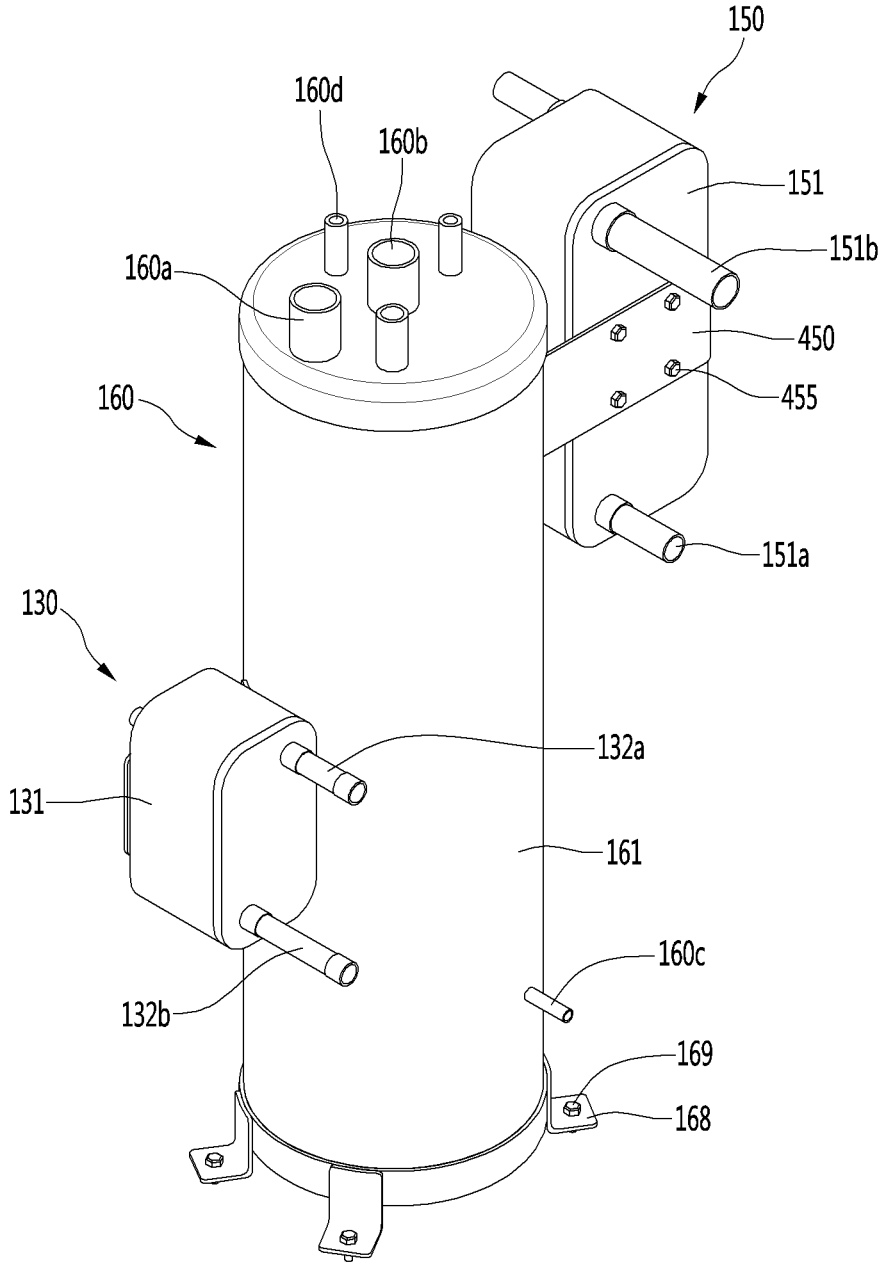

[Fig. 5]
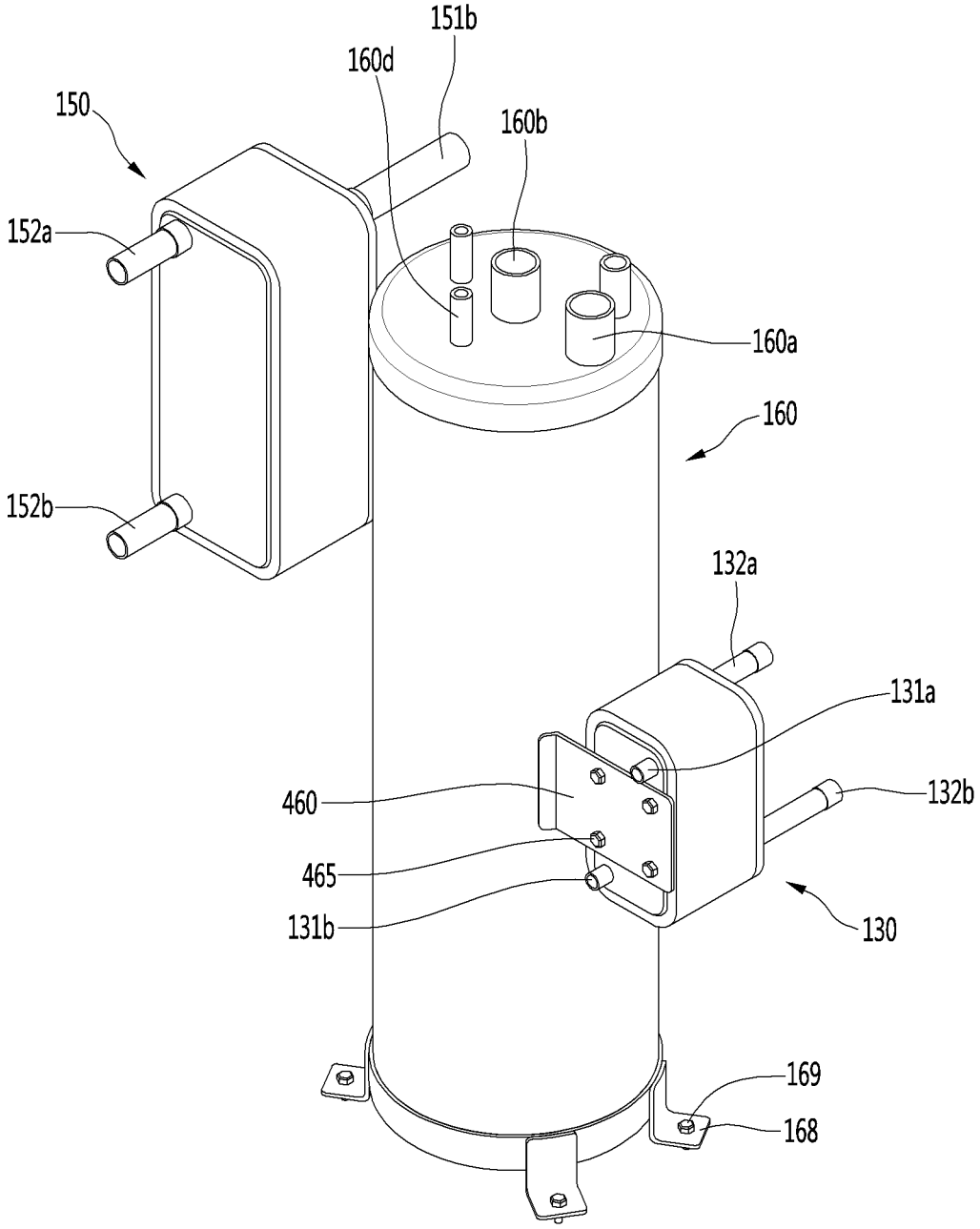

[Fig. 6]
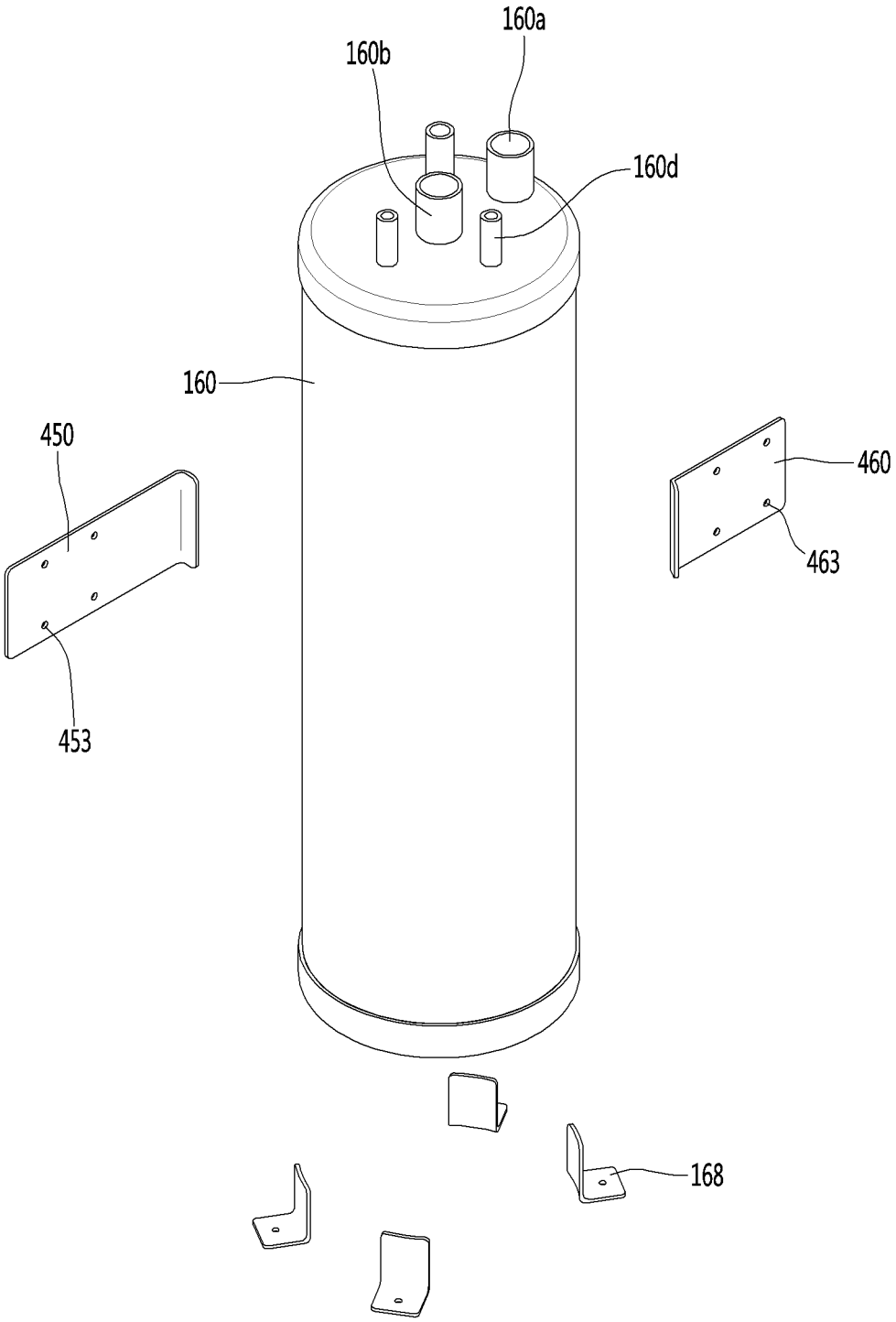

[Fig. 7]
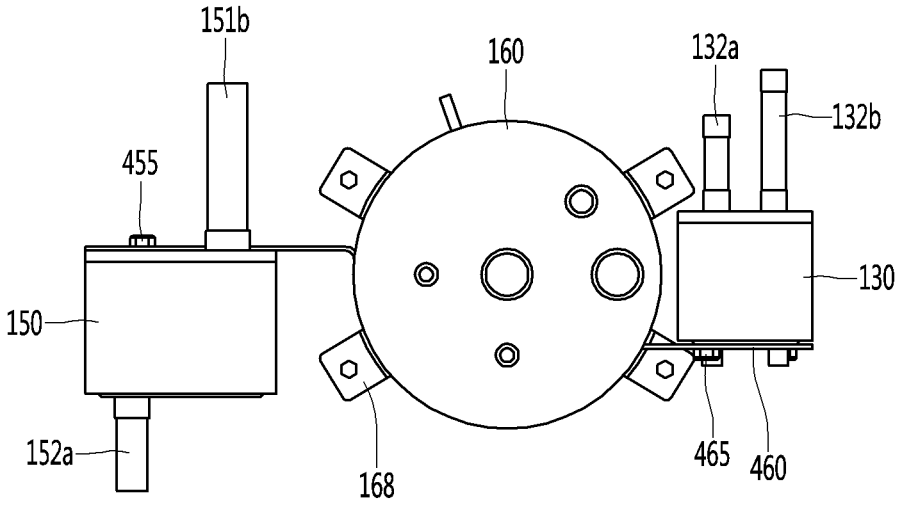

[Fig. 8]
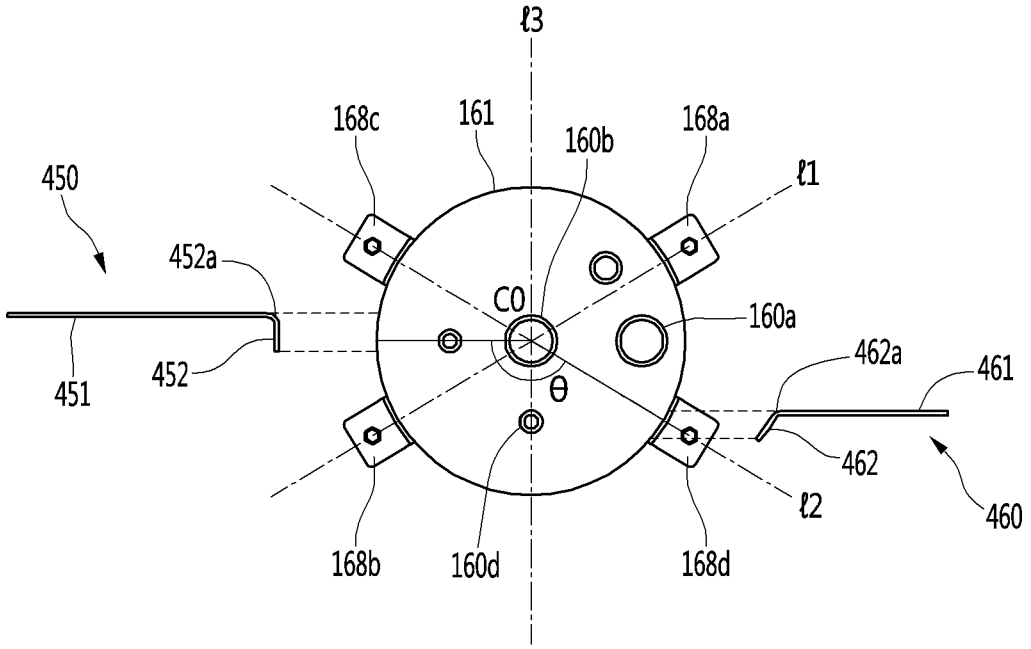

[Fig. 9]
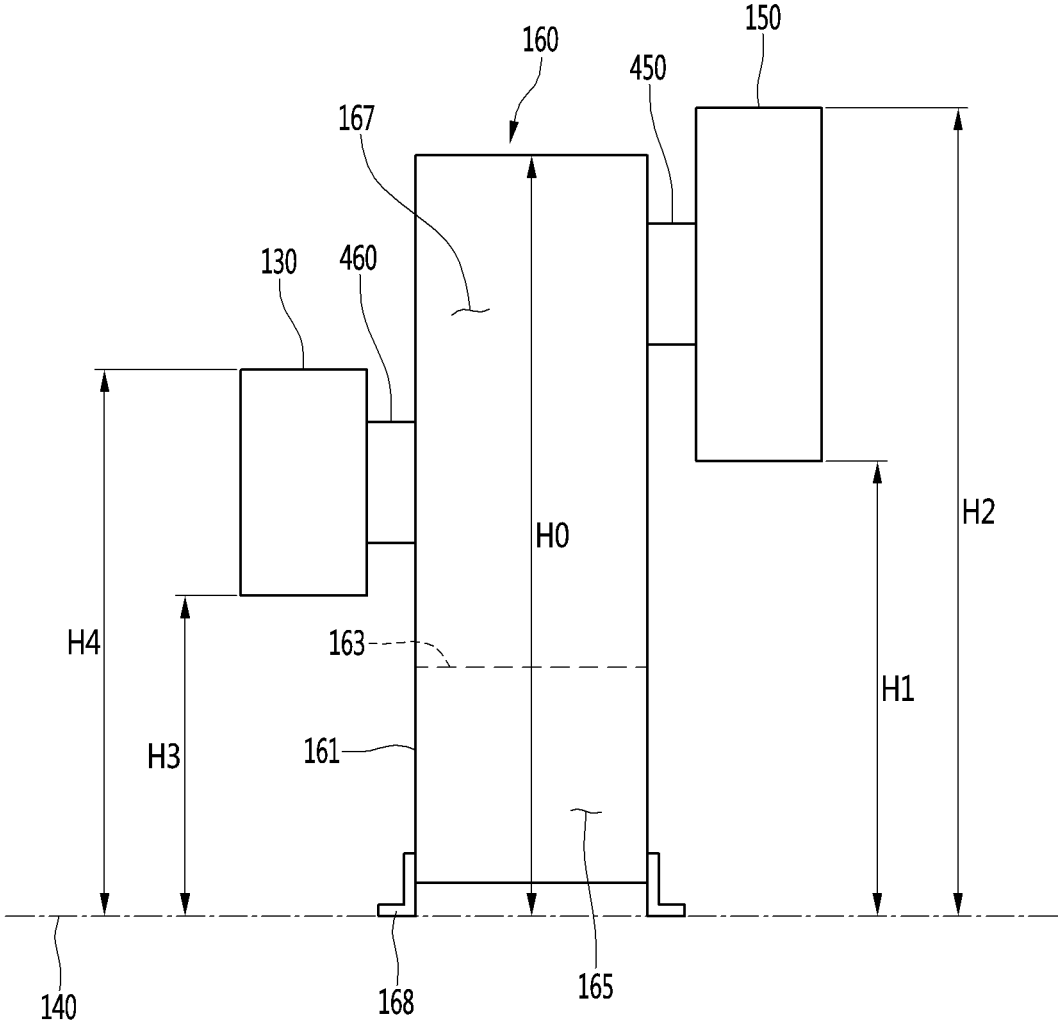

OUTDOOR UNIT OF GAS HEAT PUMP SYSTEM

CROSS-REFERENCE TO RELATED PATENT APPLICATIONS

This application is a U.S. National Stage Application under 35 U.S.C. § 371 of PCT Application No. PCT/KR2018/014217, filed Nov. 19, 2018, which claims priority to Korean Patent Application No. 10-2017-0155040, filed Nov. 20, 2017, whose entire disclosures are hereby incorporated by reference.

TECHNICAL FIELD

The present invention relates to an outdoor unit of a gas heat pump system.

BACKGROUND ART

A heat pump system may be a system having a refrigeration cycle in which cooling or heating operations are performed and be interlocked with a hot water supply device and a cooling/heating device. That is, hot water may be produced, or air-conditioning for the cooling and heating operations may be performed using a heat source obtained by heat-exchange between a refrigerant of the refrigeration cycle and a predetermined heat storage medium.

For the refrigerant cycle, a condenser that compresses the refrigerant, a condenser that condenses the refrigerant compressed in the compressor, an expansion device that depressurizes the refrigerant condensed in the condenser, and an evaporator that evaporates the depressurized refrigerant are provided.

The heat pump system includes a gas heat pump (GHP) system. A high-capacity compressor, which is not intended for domestic use but for industries or for air-conditioning large buildings is required. That is, the gas heat pump system may be used as a system using a gas engine, instead of an electric motor so as to drive the compressor for compressing a large amount of refrigerant into a high-temperature high-pressure gas.

The gas heat pump system includes an engine that generates power by using a mixture (hereinafter, referred to as a mixed fuel) of a fuel and air, an air supply device that supplies the mixed fuel to the engine, a fuel supply device, and a mixer that mixes the air with the fuel.

The engine may include a cylinder, to which the mixed fuel is supplied, and a piston, which is movably provided in the cylinder. The air supply device may include an air filter that purifies the air. Also, the fuel supply device may include a zero governor for supping the fuel having a constant pressure.

The gas heat pump system may include cooling water, which cools the engine while being circulated in the engine. The cooling water may absorb waste heat of the engine, and the absorbed waste heat may be supplied to the refrigerant circulated in the gas heat pump system to assist performance enhancement of the system. In particular, when a heating operation is performed due to a low temperature of the external air, evaporation performance in the refrigeration cycle may be improved.

The gas heat pump system further includes a supercooling heat exchanger for supercooling the condensed refrigerant. In the supercooling heat exchanger, the condensed main refrigerant and the branched refrigerant that is branched from the condensed refrigerant and is depressurized are heat-exchanged with each other.

A plurality of components of the gas heat pump system may be disposed inside an outdoor unit. In order to efficiently utilize a limited internal space of the outdoor unit, it is necessary to locate the plurality of components at appropriate positions.

In particular, since a refrigerant pipe or a cooling water pipe has to be connected in the auxiliary heat exchanger and the supercooling heat exchanger, a surrounding space has to be sufficiently secured. Also, since each of the auxiliary heat exchanger and the supercooling heat exchanger has a relatively heavy weight, it is necessary to be stably supported.

In the outdoor unit of the gas heat pump system according to the related art, there is a problem that a separate frame for supporting the auxiliary heat exchanger and the supercooling heat exchanger has to be provided. Particularly, in order to stably support the auxiliary heat exchanger and the supercooling heat exchanger, there is a problem that a plurality of frames are required to increase in material cost.

Also, the auxiliary heat exchanger and the supercooling heat exchanger are generally mounted on a main frame provided at an edge of the outdoor unit. According to this arrangement, there is a problem that a distance between each of the auxiliary heat exchanger and the supercooling heat exchanger and other components of the refrigerant cycle or other components of the cooling water cycle such as the engine increases so that the refrigerant pipe or the cooling water pipe increases in length.

A prior art document with respect to the gas heat pump system according to the related art is as follows.

1. Registration Number (Filing data): 10-1341533 (Dec. 9, 2013)

2. Title of The Invention: Gas Heat pump System And Method For Controlling The Same

DISCLOSURE OF THE INVENTION

Technical Problem

The present invention has been proposed to solve these problems, and an object of the present invention is to provide an outdoor unit of a gas heat pump system, in which a support structure capable of stably supporting a heat exchanger is provided.

In particular, an object of the present invention is to provide an outdoor unit of a gas heat pump system in which a heat exchanger is directly supported by a component (hereinafter, referred to as a support component) of a refrigerant cycle so that a separate frame structure for supporting the heat exchanger is capable of being removed.

In addition, an object of the present invention is to provide an outdoor unit of a gas heat pump system in which a relatively heavy component, for example, a storage tank is capable of being utilized as a support component so as to stably support a heat exchanger.

In addition, an object of the present invention is to provide an outdoor unit of a gas heat pump system in which a fixing bracket is provided to stably support a heat exchanger on a support component.

In addition, an object of the present invention is to provide an outdoor unit of a gas heat pump system in which a plurality of heat exchangers are disposed on both sides of a support component to prevent a center of gravity of the support component from leaning to one side.

In addition, an object of the present invention is to provide an outdoor unit of a gas heat pump system in which a refrigerant pipe or a cooling water pipe connected to a plurality of heat exchangers has a relatively short length.

Technical Solution

An outdoor unit of a gas heat pump system according to an embodiment of the present invention includes: a storage tank provided at a suction-side of the compressor to store a refrigerant to be supplied to the compressor; a heat exchanger in which the refrigerant flowing through a refrigerant pipe is heat-exchanged, or cooling water flowing through a cooling water pipe is heat-exchanged, wherein the heat exchanger is supported by the storage tank so that a separate frame structure for installing the heat exchanger is not required.

The heat exchanger may include a plate heat exchanger.

The heat exchanger may include an auxiliary heat exchanger or a supercooling heat exchanger.

The heat exchanger may be supported on an outer circumferential surface of the storage tank and thus be stably supported.

The heat exchanger may include first and second heat exchangers, and since the first and second heat exchangers are coupled to both sides of the outer circumferential surface of the storage tank, a center of gravity of the storage tank may be stably provided.

The outdoor unit may further include a fixing bracket provided between the heat exchanger and the outer circumferential surface of the storage tank to stably support the heat exchanger.

The fixing bracket may include: a first part coupled to the heat exchanger; a second part coupled to the outer circumferential surface of the storage tank; and a bent part bent towards the second part from the first part.

The outdoor unit may further include a coupling member configured to pass through a coupling hole defined in the first part so as to be coupled to the heat exchanger so that the heat exchanger and the fixing bracket are firmly coupled to each other.

A first virtual line extending from an inner center (Co) of the storage tank to the first point of the outer circumferential surface of the storage tank and a second virtual line extending from the inner center (Co) of the storage tank to the second point of the outer circumferential surface of the storage tank may be angled at a predetermined angle (θ), and the predetermined angle (θ) may range of 90 degrees to 180 degrees to prevent a center of gravity of the storage tank from leaning to one side.

The storage tank may include: a case in which a refrigerant storage space is defined; and a partition wall disposed inside the case to partition the refrigerant storage space into an upper space and a lower space.

A gas/liquid separator provided at the suction-side of the compressor to separate a gas refrigerant of the refrigerant may be defined in the upper space, and a receiver configured to store a liquid refrigerant of the refrigerant may be defined in the lower space.

The heat exchanger may be coupled to the outer circumferential surface of the storage tank at an upper side of the partition wall to balance the center of gravity of the storage tank.

Advantageous Effects

According to the gas heat pump system according to the embodiment of the present invention, since the heat exchanger is directly supported on the cycle component of the system, the separate frame for supporting the heat exchanger may not be required, and thus the outdoor unit may have the simple structure and be reduced in manufacturing cost.

In particular, since the heat exchanger is supported on the relatively heavy storage tank, the stably supported state of the heat exchanger may be realized.

In addition, since the fixing bracket is provided on the outer circumferential surface of the storage tank, and the heat exchanger is supported through the fixing bracket, the support structure of the heat exchanger may be easily realized.

In addition, since the plurality of heat exchangers are disposed on both sides of the support component, in the state in which the plurality of heat exchangers are supported on the storage tank, the effect of preventing the center of gravity of the storage tank from leaning to the one side may be realized. Accordingly, the vibration that is generated in the storage tank 160 may be reduced.

In addition, since the heat exchanger is directly supported by the cycle component, the spaced distance between the heat exchanger and other cycle components is short, and thus, the length of the refrigerant pipe or the cooling water pipe that connects the heat exchanger to the cycle component may be relatively short.

BRIEF DESCRIPTION OF THE DRAWINGS

FIG. 1 is a cycle view illustrating a configuration of a gas heat pump system according to an embodiment of the present invention.

FIG. 2 is a view illustrating an internal configuration of an outdoor unit of the gas heat pump system according to an embodiment of the present invention.

FIG. 3 is a view illustrating a state in which a storage tank and a heat exchanger are installed on a base of the outdoor unit according to an embodiment of the present invention.

FIGS. 4 and 5 are perspective views illustrating a configuration of a tank assembly according to an embodiment of the present invention.

FIG. 6 is an exploded perspective view illustrating configurations of a storage tank, a fixing bracket, and a tank leg according to an embodiment of the present invention.

FIG. 7 is a plan view illustrating the configuration of the tank assembly according to an embodiment of the present invention.

FIG. 8 is an exploded view illustrating configurations of the storage tank and the fixing bracket according to an embodiment of the present invention.

FIG. 9 is a schematic view illustrating installed positions of the storage tank and a plurality of heat exchangers according to an embodiment of the present invention.

MODE FOR CARRYING OUT THE INVENTION

Hereinafter, exemplary embodiments will be described with reference to the accompanying drawings. The invention may, however, be embodied in many different forms and should not be construed as being limited to the embodiments set forth herein; rather, that alternate embodiments included in other retrogressive inventions or falling within the spirit and scope of the present disclosure will fully convey the concept of the invention to those skilled in the art.

FIG. 1 is a cycle view illustrating a configuration of a gas heat pump system according to an embodiment of the present invention.

Referring to FIG. 1, a gas heat pump system 10 according to an embodiment of the present invention includes a plurality of components, which constitute a refrigeration cycle of an air-conditioning system. In detail, in the refrigerant cycle, a compressor 110 compressing a refrigerant and a four-way valve 117 that switches a direction of the refrigerant compressed in the compressor 110 are provided.

The gas heat pump system 10 further includes an outdoor heat exchanger 120 and an indoor unit 20. The indoor unit 20 may include an indoor heat exchanger and an indoor expansion device. The outdoor heat exchanger 120 may be provided in an outdoor unit disposed at an outdoor side, and the indoor heat exchanger may be provided in the indoor unit disposed at an indoor side. The refrigerant passing through the four-way valve 117 may flow to the outdoor heat exchanger 120 or the indoor heat exchanger according to an operation mode.

In detail, when the system 10 operate in a cooling operation mode, the refrigerant passing through the four-way valve 117 flows toward the indoor unit 20 via the outdoor heat exchanger 120. On the other hand, when the system 10 operates in a heating operation mode, the refrigerant passing through the four-way valve flows toward the outdoor heat exchanger 120 via the indoor unit 20.

The system 10 further includes a refrigerant pipe 170 that connects the compressor 110, the outdoor heat exchanger 120, and the indoor unit 20 to each other to guide a flow of the refrigerant.

A configuration of the system 10 will be described based on the cooling operation mode.

The refrigerant flowing to the outdoor heat exchanger 120 may be condensed by being heat-exchanged with external air. An outdoor fan 122 that blows the external air is provided at one side of the outdoor heat exchanger 120.

A main expansion device 125 that depressurizes the refrigerant may be provided at an outlet-side of the outdoor heat exchanger 120. For example, the main expansion device 125 may include an electronic expansion valve (EEV) that is adjustable in degree of opening. When the cooling operation is performed, the main expansion device 125 is fully opened, and thus, the refrigerant is not depressurized.

A supercooling heat exchanger 130, which additionally cools the refrigerant, is provided at an outlet-side of the main expansion device 125. A supercooling passage 132 is connected to the supercooling heat exchanger 130. The supercooling passage 132 is branched from the refrigerant pipe 170 and connected to the supercooling heat exchanger 130. The supercooling passage 132 may be referred to as a "branch pipe".

Also, a supercooling expansion device 135 is installed in the supercooling passage 132. The refrigerant flowing through the supercooling passage 132 may be depressurized while passing through the supercooling expansion device 135. When the supercooling expansion device 135 is closed, the flow of the refrigerant may be restricted in the supercooling passage 132. For example, the main expansion device 125 may include an electronic expansion valve (EEV) that is adjustable in degree of opening.

In the supercooling heat exchanger 130, heat exchange may be performed between a refrigerant (hereinafter, referred to as a main refrigerant) in the refrigerant pipe 170 and a refrigerant (hereinafter, referred to as a branch refrigerant) in the supercooling passage 132. In the heat exchange process, the refrigerant in the refrigerant pipe 170 is supercooled to absorb heat of the refrigerant in the supercooling passage 132.

For example, the supercooling heat exchanger 130 includes a plate heat exchanger. One or more main refrigerant passage and one or more branch refrigerant passage through which the branch refrigerant flows may be disposed to be stacked on each other in the supercooling heat exchanger 130 so as to be heat-exchanged with each other.

The supercooling passage 132 is connected to the gas/liquid separator 167. In detail, the supercooling passage 132 may be connected to one point of the second extension pipe 172. The refrigerant in the supercooling passage 132 heat-exchanged in the supercooling heat exchanger 130 may be introduced into the gas/liquid separator 167 of the storage tank 160.

The refrigerant in the refrigerant pipe 170, which passes through the supercooling heat exchanger 130, flows toward the indoor unit 20 and then is depressurized in the indoor expansion device and evaporated in the indoor heat exchanger. The indoor expansion device may be installed inside the indoor unit 20 and may be provided as the electronic expansion valve (EEV).

The refrigerant evaporated from the indoor heat exchanger may pass through the four-way valve 117 and may be introduced into the gas/liquid separator 167 via the first and second extension pipes 171 and 172. In detail, the refrigerant passing through the four-way valve 117 may flow through the first extension pipe 171, flow through the second extension pipe 172 from a third branch portion 171*a*, and be introduced into the gas/liquid separator 167.

The first extension pipe 171 is understood as a portion of the refrigerant pipe 170 extending from the four-way valve 117 to an auxiliary heat exchanger 150 and has the third branch portion 171*a*. Also, the second extension pipe 172 may be understood as a portion of the refrigerant pipe 170 extending from the third branch portion 171*a* to the gas/liquid separator 167.

The auxiliary heat exchanger 150 may be a heat exchanger that is capable of being heat-exchanged between a low-pressure refrigerant and high-temperature cooling water. For example, the auxiliary heat exchanger 150 may include a plate heat exchanger. For example, one or more refrigerant passage and one or more cooling water passage may be disposed to be stacked on each other in the auxiliary heat exchanger 150 so as to be heat-exchanged with each other.

The refrigerant pipe 170 further include a third extension pipe 173 extending from the auxiliary heat exchanger 150 to the supercooling heat exchanger 130. A fourth branch portion 173*a* may be provided in the third extension pipe 173.

Also, the refrigerant pipe 170 further includes a fourth extension pipe 174 extending from the fourth branch portion 173*a* to the outdoor heat exchanger 120. The main expansion device 125 may be installed in the fourth extension pipe 174.

An auxiliary heat exchanger valve 155 may be installed in the first extension pipe 171. For example, the auxiliary heat exchanger valve 155 includes an electronic expansion valve (EEV) capable of adjusting a degree of opening. When the heating operation is performed, the auxiliary heat exchanger valve 155 may be controlled to be closed so that the flow of the refrigerant to the auxiliary heat exchanger 150 is restricted. Thus, the refrigerant evaporated in the indoor unit 20 may pass to the gas/liquid separator 167 via the four-way valve 117, the third branch 171*a* of the first extension pipe 171, and the second extension pipe 172.

When the refrigerant is introduced into the gas/liquid separator 167, gaseous refrigerant is separated from the refrigerant, and the separated gas refrigerant may be suctioned into the compressor 110 via the suction pipe 175. The suction pipe 175 may be understood as a refrigerant pipe extending from the gas/liquid separator 167 to the compressor 110. For example, the suction pipe 175 may extend upward from a top surface of the gas/liquid separator 167 and may extend downward by being bent at least twice.

The gas heat pump system 10 further includes a storage tank 160 in which the refrigerant is stored. The storage tank 160 includes a case 161 defining an outer appearance thereof and a partition wall 163 provided inside the case 161 to partition an internal space of the case 161 into upper and lower spaces.

The upper space of the case 161, which is partitioned by the partition wall 163, defines a gas/liquid separator 167 in which a low-pressure refrigerant is stored. Also, the lower space of the case 161, which is partitioned by the partition wall 163, defines a receiver 165 in which a high-pressure refrigerant is stored. That is, the storage tank 160 may have a structure in which the gas/liquid separator and the receiver are integrated with each other to form one case 161.

Since the liquid refrigerant is stored in the receiver 165, and a two-phase refrigerant is stored in the gas/liquid separator 167, a volume of the gas/liquid separator 167 may be larger than that of the receiver 165. In other words, a height of the gas/liquid separator 167 may be greater than that of the receiver 165.

The gas heat pump system 10 further includes a receiver inlet passage 136 that transfers the condensed refrigerant to the receiver 165. The receiver inlet passage 136 may be branched from a pipe connecting the supercooling heat exchanger 130 to the indoor unit 20 to extend to the receiver 165. That is, the receiver inlet passage 136 may be connected to a lower portion of the case 161.

In the receiver inlet passage 136, a receiver inlet valve 137 that selectively allows the refrigerant flow in the receiver inlet passage 136 may be installed. For example, the receiver inlet valve 137 may include a solenoid valve that is capable of being controlled to turn on/off. When the receiver inlet valve 137 is opened, at least a portion of the refrigerant flowing from the supercooling heat exchanger 130 to the indoor unit 20 or the refrigerant flowing from the indoor unit 20 to the supercooling heat exchanger 130 may be introduced into the receiver 165 through the receiver inlet passage 136. Due to the flow of the refrigerant, at least a portion of the refrigerant circulated in the system is stored in the receiver 165.

A capillary tube 138 for adjusting an amount of refrigerant flowing through the receiver inlet passage 136 may be installed in the receiver inlet passage 136. A diameter of the capillary tube 138 may be less than that of the refrigerant pipe 170 so that a flow rate of the refrigerant is reduced.

The gas heat pump system 10 further includes a receiver outlet passage 139 for transferring the refrigerant stored in the receiver 165 to the gas/liquid separator 167. The receiver outlet passage 139 may extend upward from the receiver 165 and be connected to the gas/liquid separator 167. That is, the receiver outlet passage 139 may be connected to an upper portion of the case 161, for example, a top surface of the case 161.

A receiver outlet valve **139*a* that selectively allows the refrigerant flow in the receiver outlet passage 139 may be installed in the receiver outlet passage 136. For example, the receiver outlet valve 139*a* may include a solenoid valve capable of being controlled to turn on/off. When the receiver outlet valve 139*a* is opened, the high-pressure refrigerant stored in the receiver 165 may flow to the gas/liquid separator 167** that provides a low pressure.

The refrigerant introduced into the gas/liquid separator 167 may be re-introduced into the system and then circulated. The refrigerant stored in the receiver 165 has a relatively high-temperature and high-pressure, and the refrigerant stored in the gas/liquid separator 167 has a relatively low-temperature and low-pressure. The refrigerant stored in the gas/liquid separator 167 may be vaporized by being heat-exchanged with the refrigerant stored in the receiver 165 through the partition wall 163. Also, the vaporized refrigerant may be discharged from the gas/liquid separator 167 so as to be circulated in the system.

The gas heat pump system 10 further includes an engine 200 that generates power by burning a mixture of a fuel and air and a power transmission device 205 that transmits the power generated by the engine 200 to the compressor 110. For example, the power transmission device 205 may include a pulley and a belt.

The gas heat pump system 10 further includes a cooling water pipe 360 through which cooling water for cooling the engine 200 flows. A cooling water pump 300 that generates flow force of the cooling water, a plurality of flow switching portions 310 and 320 that switch a flow direction of the cooling water, and a radiator 330 that cools the cooling water may be installed in the cooling water pipe 36.

The plurality of flow switching portions 310 and 320 include a first flow switching portion 310 disposed at an outlet-side of the engine 200 and a second flow switching portion 320 connected to the first flow switching portion 310. For example, each of the first flow switching portion 310 and the second flow switching portion 320 may include a three-way valve.

The radiator 330 may be installed at one side of the outdoor heat exchanger 120, and the cooling water passing through the radiator 330 may be heat-exchanged with external air by driving the outdoor fan 122. In this process, the refrigerant may be cooled. For example, when the cooling operation is performed, the cooling water may be cooled through the radiator 330.

When the cooling water pump 300 is driven, the cooling water may pass through the engine 200 and an exhaust gas heat exchanger 240, which will be described later, and then pass through the first flow switching portion 310 and the second flow switching portion 320 to selectively flow to the radiator 330 or the auxiliary heat exchanger 150.

The gas heat pump system 10 further include an engine 200 generating power for driving the compressor 110 and an exhaust gas heat exchanger 240 which is provided at an outlet-side of the engine 200 and into which an exhaust gas generated after the mixed fuel is burned is introduced. In the exhaust gas heat exchanger 240, heat exchange may be performed between the cooling water and the exhaust gas.

The cooling water pipe 360 includes a first pipe 361 extending from the radiator 330 toward the engine 200. In detail, the first pipe 361 may include a first pipe portion extending from the radiator 330 to the exhaust gas heat exchanger 240 and a second pipe portion extending from the exhaust gas heat exchanger 240 to the engine 200. The cooling water pump 300 that forces the flow of the refrigerant may be installed in the first pipe portion. The cooling water flowing through the first pipe 361 is heat-exchanged with the exhaust gas while passing through the exhaust gas heat exchanger 240 and then is introduced into the engine 200 to collect waste heat of the engine 200. In this process, the cooling water may absorb heat.

The cooling water pipe 360 further includes a second pipe 362 that guides the cooling water passing through the engine 200 to the first flow switching portion 310. The second pipe 362 is understood as a pipe extending from the outlet-side of the engine 200 to a first port of the first flow switching portion 310.

The cooling water pipe 360 further includes a third pipe 363 that guides the cooling water from the first flow switching portion 310 to the second flow switching portion 320. The third pipe 363 is understood as a pipe extending from a second port of the first flow switching portion 310 to a first port of the second flow switching portion 320.

The cooling water pipe 360 further includes a fourth pipe 364 that guides the cooling water from the second flow switching portion 320 to the auxiliary heat exchanger 150. The fourth pipe 364 extends from the second port of the second flow switching portion 320 to the auxiliary heat exchanger 150 and then passes through the auxiliary heat exchanger 150 to extend to the first point of the first pipe 361.

The cooling water pipe 360 further includes a fifth pipe 365 that guides the cooling water from the second flow switching portion 320 to the radiator 150. The fifth pipe 365 may extend from a third port of the second flow switching portion 320 to the radiator 150. The fifth pipe 365 is connected to the first pipe 361.

The cooling water pipe 360 further includes a sixth pipe 366 that guides the cooling water from the first flow switching portion 310 to the first pipe 361. The sixth pipe 366 may be understood as a pipe extending from a third port of the first flow switching portion 310 and coupled to the second point of the first pipe 361.

For example, when a temperature of the cooling water passing through the engine 200 is below a predetermined temperature, an effect of being heat-exchanged with the refrigerant by allowing the cooling water to flow to the auxiliary heat exchanger 150 or the radiator 330 may be insignificant. Thus, the cooling water introduced into the first port of the first flow switching portion 310 may be bypassed to the first pipe 361 through the sixth pipe 366.

FIG. 2 is a view illustrating an internal configuration of the outdoor unit of the gas heat pump system according to an embodiment of the present invention, and FIG. 3 is a view illustrating a state in which the storage tank and the heat exchanger are installed on the base of the outdoor unit according to an embodiment of the present invention.

Referring to FIGS. 2 and 3, the gas heat pump system according to an embodiment of the present invention includes the outdoor unit in which a plurality of components are installed. Other components except for the indoor unit 20 may be installed in the outdoor unit based on the cycle diagram illustrated in FIG. 1.

The outdoor unit includes a base 400 and a plurality of components installed on a top surface of the base 400. The plurality of components may include a compressor 110, an outdoor heat exchanger 120, a high-cooling heat exchanger 130, an auxiliary heat exchanger 150, an engine 200, an exhaust gas heat exchanger 240, and a cooling water pump 300. Also, a refrigerant pipe 170 and a cooling water pipe 360, which connect the plurality of components to each other may be further installed in the outdoor unit.

A base leg 410 supporting the base 400 may be provided below the base 400. A plurality of base legs 410 may be provided. The plurality of base legs 410 may be disposed to be spaced apart from each other in a left-right direction of the base 400.

As illustrated in FIG. 2, components through which the mixed fuel, the exhaust gas, the cooling water, and the like flow, such as the engine 200, the exhaust gas heat exchanger 240, and the cooling water pump 300 may be disposed at one side of an upper portion of the base 400. For example, the components may be disposed at a right side of the top surface of the base 400.

On the other hand, the cycle component for circulating the refrigerant, i.e., the components such as the compressor (not shown), the storage tank 160, the supercooling heat exchanger 130, and the auxiliary heat exchanger 150 may be disposed at the other side of the upper portion of the base 400. Also, the refrigerant pipe 170 connecting the components to each other may also be mainly disposed at the other side of the upper portion of the base 400.

The cooling water pipe 360 connecting the auxiliary heat exchanger 150, the engine 200, the exhaust gas heat exchanger 240, and the cooling water pump 300 to each other may lengthily extend in the left-right direction of the base 400.

Also, the auxiliary heat exchanger 150 and the supercooling heat exchanger 130 are configured to be supported on an outer surface of the storage tank 160.

In the case of the outdoor unit of the gas heat pump system according to the related art, there is a problem that, since a frame is provided at an edge of the base, and the heat exchanger is supported on the frame, a distance between the heat exchanger and the engine relatively increases, and thus, the cooling water pipe has to increase in length. Also, there is a problem that a distance between the heat exchanger and each of other components of the refrigerant cycle also increases, and thus, the refrigerant pipe has also to increase.

In this embodiment, since the auxiliary heat exchanger 150 and the supercooling heat exchanger 130 are directly supported on the storage tank 160, there is an effect that this problem is solved.

Referring to FIG. 3, the storage tank 160 may be supported on the top surface of the base 400. The storage tank 160 includes a case 161 having a cylindrical shape and defining a refrigerant storage space, an upper cap 161*a* coupled to an upper side of the case 161, and a lower cap 161*b* coupled to a lower portion of the case 161. The upper cap 161*a* defines a top surface of the storage tank 160, and the lower cap 161*b* defines a lower surface of the storage tank 160.

A first inflow port 160*a* that guides an inflow of the refrigerant into the gas/liquid separator 167 and a first outflow port 160*b* that guides an outflow of the gas refrigerant, which is separated in the gas/liquid separator 167, from the storage tank 160 are provided in the upper cap 161*a*.

A second outflow port 160*c* connected to one side of the receiver outlet passage 139 is provided in an outer circumferential surface of the case 161. Also, a second inflow port 160*d* connected to the other side of the receiver outlet passage 139 is provided in the upper cap 161*a*. The refrigerant of the receiver 165 may be discharged through the second outflow port 160 and flows through the receiver outlet passage 139 and be introduced into the gas/liquid separator 167 through the second inflow port 160*d*.

The storage tank 160 includes a tank leg 168 provided on the lower portion of the case 161 and coupled to the base 400. The tank leg 168 may be coupled to the lower cap 161*b*.

A plurality of tank legs 168 are provided, and the plurality of tank legs 168 may be spaced apart from each other along a circumference of the lower cap 161*b* so as to be arranged in a circumferential direction. For example, the plurality of tank legs 168 may include four tank legs 168.

Each of the tank legs 168 has a bent shape, a first part of the tank leg 168 is coupled to the base 400, and a second part is coupled to an outer circumferential surface of the lower cap 161*b*.

The heat exchangers 130 and 150 are supported on the storage tank 160. The heat exchangers 130 and 150 include the supercooling heat exchanger 130 and the auxiliary heat exchanger 150. The auxiliary heat exchanger 150 may be supported on the storage tank 160 by a first fixing bracket 450, and the supercooling heat exchanger 130 may be supported on the storage tank 160 by a second fixing bracket 460.

FIGS. 4 and 5 are perspective views illustrating a configuration of a tank assembly according to an embodiment of the present invention, and FIG. 6 is an exploded perspective view illustrating configurations of the storage tank, the fixing bracket, and the tank leg according to an embodiment of the present invention.

Referring to FIGS. 4 and 5, a tank assembly according to an embodiment of the present invention further include the storage tank 160 in which the refrigerant is stored, the plurality of heat exchangers 130 and 150 supported on the storage tank 160, and first and second fixing brackets 450 and 460 extending from an outer circumferential surface of the storage tank 160 to the plurality of heat exchangers 130 and 150.

The first fixing bracket 450 is disposed between the first point on the outer circumferential surface of the storage tank 160 and the first heat exchanger 150. Also, the second fixing bracket 460 is disposed between the second point on the outer circumferential surface of the storage tank 160 and the second heat exchanger 130.

The plurality of heat exchangers 130 and 150 may be coupled to be supported on both sides of the storage tank 160 by the first and second fixing brackets 450 and 460.

Each of the plurality of heat exchangers 130 and 150 includes the auxiliary heat exchanger 150. For convenience of description, the auxiliary heat exchanger 150 may be referred to as a "first heat exchanger". The auxiliary heat exchanger 150 includes a heat exchange body 151 having a substantially hexahedral shape and a plurality of input/output ports provided in the heat exchange body 151.

The plurality of input/output ports include a refrigerant port and a cooling water port. For example, the refrigerant port may be provided in one surface of the heat exchange body 151, and the cooling water port may be provided in the other surface of the heat exchange body 151. The one surface and the other surface may be surfaces facing each other.

The refrigerant port includes a refrigerant inflow port 151*a* into which the refrigerant is introduced and a refrigerant outflow port 151*b* from which the heat-exchanged refrigerant is discharged. Also, the cooling water port includes a cooling water inflow port 152*a* into which the cooling water is introduced and a cooling water outflow port 152*b* from which the heat-exchanged cooling water is discharged.

The auxiliary heat exchanger 150 may be coupled to the first fixing bracket 450. In detail, the first fixing bracket 450 may have a plate shape, and a portion between a part coupled to the storage tank 160 and a part coupled to the auxiliary heat exchanger 150 may have a bent shape.

A first coupling member 455 may be coupled to the first fixing bracket 450. The first coupling member 455 may be coupled to one surface of the heat exchange body 151 provided with the refrigerant port. Also, a first coupling hole 453 to which the first coupling member 455 is coupled may be defined in the first fixing bracket 450. For example, the first coupling member 455 may include a bolt and a nut.

The first coupling members 455 may be provided in plurality. For example, in order to stably support the auxiliary heat exchanger 150, the first coupling member 455 may be provided with four, arranged in a matrix form having two rows and two columns, and—coupled to the first fixing bracket 450.

Each of the plurality of heat exchangers 130 and 150 include the supercooling heat exchanger 130. For convenience of description, the supercooling heat exchanger 150 may be referred to as a "second heat exchanger". The supercooling heat exchanger 130 includes a heat exchange body 131 having a substantially hexahedral shape and a plurality of input/output ports provided in the heat exchange body 131.

The plurality of input/output ports include first and second refrigerant ports through which the main refrigerant is introduced and discharged and third and fourth refrigerant ports through which the branch refrigerant is introduced and discharged. For example, the first and second refrigerant ports may be provided in one surface of the heat exchange body 131, and the third and fourth refrigerant ports may be provided in the other surface of the heat exchange body 131. The one surface and the other surface may be surfaces facing each other.

The first and second refrigerant ports include a main refrigerant inflow port 131*a* into which the main refrigerant is introduced and a main refrigerant outflow port 151*b* from which the heat exchanged main refrigerant is discharged. Also, the third and fourth refrigerant ports include a branch refrigerant inflow port 132*a* into which the branch refrigerant is introduced and a branch refrigerant outflow port 132*b* from which the heat-exchanged branch refrigerant is discharged.

The supercooling heat exchanger 130 may be coupled to the second fixing bracket 460. In detail, the second fixing bracket 460 may have a plate shape, and a portion between a part coupled to the storage tank 160 and a part coupled to the auxiliary heat exchanger 150 may have a bent shape.

A second coupling member 465 may be coupled to the second fixing bracket 460. The second coupling member 465 may be coupled to one surface of the heat exchange body 131 provided with the first and second refrigerant ports. Also, a second coupling hole 463 to which the second coupling member 465 is coupled may be defined in the second coupling bracket 460. For example, the second coupling member 465 may include a bolt and a nut.

The second coupling member 465 may be provided in plurality. For example, in order to stably support the supercooling heat exchanger 130, the second coupling member 465 may be provided with four, arranged in a matrix form having two rows and two columns, and—coupled to the second fixing bracket 460.

FIG. 7 is a plan view illustrating the configuration of the tank assembly according to an embodiment of the present invention, and FIG. 8 is an exploded view illustrating configurations of the storage tank and the fixing bracket according to an embodiment of the present invention.

Referring to FIGS. 7 and 8, the first and second heat exchangers 150 and 130 according to an embodiment of the present invention may be coupled to both sides of the storage tank 160. That is, the first and second fixing brackets 450 and 460 supporting the first and second heat exchangers 150 and 130 may be disposed on both sides of the outer circumferential surface of the case 161.

In detail, the tank leg 168 includes at least four tank legs. The four tank legs include a first leg 168*a*, a second leg 168*b*, a third leg 168*c*, and a fourth leg 168*d*. The first to fourth legs are spaced apart from each other in the circumferential direction based on the outer circumferential surface of the case 161 or the lower cap 161*b*.

A first reference line l1 connecting the first and second legs 168*a* and 168*b* to each other and a second reference line l2 connecting the third and fourth legs 168*c* and 168*d* to each other may pass through an inner center Co of the case 161 or the lower cap 161*b*.

The first and fourth legs 168*a* and 168*d* and the second and third legs 168*b* and 168*c* may be disposed on both sides of a third reference line l3 extending from the inner center Co of the case 161 toward the outer circumferential surface of the case 161.

Also, the first fixing bracket 450 may be coupled to the outer circumferential surface of the case 161 provided on one side of the third reference line l3, and the second fixing bracket 460 may be coupled to the outer circumferential surface of the case 161 provided on the other side of the third reference line l3. According to this configuration, since the first and second heat exchangers 150 and 130 supported by the first and second fixing brackets 450 and 460 are disposed on both the sides of the storage tank 160, a center of gravity of the storage tank 160 may be prevented from leaning to one side. As a result, the first and second heat exchangers 150 and 130 may be stably supported on the storage tank 160.

The first fixing bracket 450 may have a bent shape. In detail, the first fixing bracket 450 includes a first part 451 coupled to the first heat exchanger 150, a second part 452 coupled to the outer circumferential surface of the storage tank 160, and a bent part 452*a* bent from the first part 451 toward the second part 452. Due to the configuration of the first fixing bracket 450, the first heat exchanger 150 having the hexahedral shape and the storage tank 160 having the cylindrical outer circumferential surface may be easily coupled to each other.

The second fixing bracket 460 may have a bent shape. In detail, the second fixing bracket 460 includes a first part 461 coupled to the second heat exchanger 130, a second part 462 coupled to the outer circumferential surface of the storage tank 160, and a bent part 462*a* bent from the first part 461 toward the second part 462. Due to the configuration of the second fixing bracket 460, the second heat exchanger 130 having the hexahedral shape and the storage tank 160 having the cylindrical outer circumferential surface may be easily coupled to each other.

A first virtual line extending radially from the inner center Co of the case 161 to the first point on the outer circumferential surface of the case 161 to which the central portion of the second part 452 of the first fixing bracket 450 is coupled and a second virtual line radially from the inner center Co of the case 161 to the second point on the outer circumferential surface of the case 161 to which the central portion of the second part 462 of the second fixing bracket 460 is coupled may be angled at a predetermined angle θ. For example, the predetermined angle θ may range of 90 degrees to 180 degrees.

FIG. 9 is a schematic view illustrating installed positions of the storage tank and the plurality of heat exchangers according to an embodiment of the present invention.

Referring to FIG. 9, the storage tank 160 according to an embodiment of the present invention has a first height Ho with respect to the base 140. Also, the partition wall 163 may has a height less than ½ of the first height Ho. Therefore, the gas/liquid separator 167 may have a height greater than that of the receiver 165.

The first heat exchanger 150 may be coupled to the outer circumferential surface of the upper portion of the storage tank 160, i.e., the outer circumferential surface of the case 161 defining the gas/liquid separator 167. In detail, the bottom surface of the first heat exchanger 150 may have a second height H1 with respect to the base 140, and the top surface of the first heat exchanger 150 may have a third height H2. For example, the third height H2 may be greater than the first height Ho or the same as the first height Ho.

The second heat exchanger 130 may be coupled to an outer circumferential surface of a substantially central portion of the storage tank 160, i.e., the outer circumferential surface of the case 161 defining the gas/liquid separator 167. Also, the second heat exchanger 130 may be disposed at a position higher than the partition wall 163. In detail, the bottom surface of the second heat exchanger 130 may have a fourth height H3 with respect to the base 140, and the top surface of the second heat exchanger 130 may have a fifth height H4. The fourth height H3 may be less than the second height H1, and the fifth height H4 may be less than the third height H2.

Since a liquid refrigerant is stored in the receiver 165, the refrigerant has a relatively heavy weight, and since a two-phase refrigerant is stored in the gas/liquid separator 167, the refrigerant may be a relatively light weight. That is, in the state in which the first and second heat exchangers 150 and 130 are not coupled to each other, the center of gravity of the storage tank 160 is positioned below an intermediate height of the storage tank 160.

Therefore, the first and second heat exchangers 150 and 130 may be disposed so that the center of gravity is formed at a position higher than the central portion of the storage tank 160 to prevent the center of gravity of the storage tank 160 from leaning to an upper or lower side of the storage tank 160. Also, due to this arrangement, it is possible to reduce the vibration that may be generated in the storage tank 160.

INDUSTRIAL APPLICABILITY

According to the embodiment of the present invention, since the heat exchanger is directly supported on the cycle component of the system, the separate frame for supporting the heat exchanger may not be required, and thus the outdoor unit may have the simple structure and be reduced in manufacturing cost. Therefore, industrial applicability is significantly high.

The invention claimed is:

1. An outdoor unit of a gas heat pump system, comprising:

a base;

a compressor installed on the base;

a storage tank provided at a suction-side of the compressor to store a refrigerant to be supplied to the compressor;

a refrigerant pipe configured to connect the compressor to the storage tank, the refrigerant pipe being configured to guide a flow of the refrigerant;

an engine which is installed on the base to provide power that drives the compressor and in which a mixed fuel of a fuel and air is burned;

a cooling water pipe configured to guide a flow of cooling water that cools the engine; and a heat exchanger in which the refrigerant flowing through the refrigerant pipe is heat-exchanged, or the cooling water flowing through the cooling water pipe is heat-exchanged, wherein the storage tank comprises:

a case in which a refrigerant storage space is defined;

a partition wall disposed inside the case to partition the refrigerant storage space into an upper space and a lower space; and a receiver configured to store liquid refrigerant of the refrigerant defined in the lower space, wherein the heat exchanger comprises first and second heat exchangers, wherein the first and second heat exchangers are coupled to an outer circumferential surface of the storage tank at first and second lateral sides and are provided above the partition wall, wherein an upper end of the second heat exchanger is positioned above a lower end of the first heat exchanger, and wherein a lower end of the second heat exchanger is positioned below the lower end of the first heat exchanger.

2. The outdoor unit according to claim 1, wherein the first and second heat exchangers each comprise a plate heat exchanger.

3. The outdoor unit according to claim 2, wherein the first heat exchanger comprises an auxiliary heat exchanger in which the refrigerant flowing through the refrigerant pipe and the cooling water flowing through the cooling water pipe are heat-exchanged with each other.

4. The outdoor unit according to claim 2, wherein the second heat exchanger comprises a supercooling heat exchanger in which the refrigerant flowing through the refrigerant pipe and the refrigerant flowing through a branch pipe branched from the refrigerant pipe are heat-exchanged with each other.

5. The outdoor unit according to claim 1, further comprising a fixing bracket provided between each of the first and second heat exchangers and the outer circumferential surface of the storage tank.

6. The outdoor unit according to claim 5, wherein each fixing bracket comprises:

a first part coupled to the respective heat exchanger;

a second part coupled to the outer circumferential surface of the storage tank; and a bent part configured to be bent towards the second part from the first part.

7. The outdoor unit according to claim 6, further comprising a coupling member configured to pass through a coupling hole defined in the first part so as to be coupled to the respective heat exchanger.

8. The outdoor unit according to claim 1, further comprising:

a first fixing bracket that extends from a first point of the outer circumferential surface of the storage tank to the first heat exchanger; and a second fixing bracket that extends from a second point of the outer circumferential surface of the storage tank to the second heat exchanger.

9. The outdoor unit according to claim 8, wherein a first virtual line extending from an inner center of the storage tank to the first point of the outer circumferential surface of the storage tank and a second virtual line extending from the inner center of the storage tank to the second point of the outer circumferential surface of the storage tank are angled at a predetermined angle, and the predetermined angle ranges from 90 degrees to 180 degrees.

10. The outdoor unit according to claim 1, wherein a gas/liquid separator provided at a suction-side of the compressor to separate gas refrigerant of the refrigerant is defined in the upper space, and wherein the receiver configured to store a-liquid refrigerant of the refrigerant is defined in the lower space.

11. The outdoor unit according to claim 1, wherein the first heat exchanger is coupled to an outer circumferential surface of an upper portion of the case and the second heat exchanger is coupled to an outer circumferential surface of a central portion of the case.

* * * * *